US005167449A

United States Patent [19]

Killough

[11] Patent Number: 5,167,449

[45] Date of Patent: Dec. 1, 1992

[54] PADDLE SHAFT ASSEMBLY WITH ADJUSTABLE-PITCH PADDLES

[75] Inventor: Bruce A. Killough, Corning, N.Y.

[73] Assignee: Corning Incorporated, Corning, N.Y.

[21] Appl. No.: 805,638

[22] Filed: Dec. 12, 1991

[51] Int. Cl.[5] ..... B01F 13/08; B01F 7/18

[52] U.S. Cl. ..... 366/247; 366/273; 366/286; 366/326; 366/327; 403/379; 403/DIG. 1; 416/205

[58] Field of Search ..... 366/293, 244, 245, 247, 366/273, 197, 274, 249, 279, 286, 325, 327, 326, 331, 343; 464/901; 403/378, 379, DIG. 1; 416/205, 244 R

[56] References Cited

U.S. PATENT DOCUMENTS

| | | | |
|---|---|---|---|
| 16,210 | 12/1856 | Lightfoot | 416/205 X |
| 77,431 | 4/1868 | Elliott | 366/247 X |
| 433,503 | 8/1890 | Wilsey | 366/326 |
| 468,158 | 2/1892 | Stewart | 366/247 |
| 1,235,658 | 8/1917 | Connor | 366/247 |
| 2,041,184 | 5/1936 | Isenhour | 366/328 X |
| 2,464,381 | 3/1949 | Donaldson et al. | 403/379 |
| 3,104,757 | 9/1963 | Dougherty et al. | 403/379 X |
| 3,572,651 | 3/1971 | Harker | 366/274 X |
| 3,622,129 | 11/1971 | Mazowski | 366/247 |
| 4,238,159 | 12/1980 | Tielens et al. | 366/327 |
| 4,355,906 | 10/1982 | Ono | 366/274 |
| 4,483,623 | 11/1984 | Eaton et al. | 366/273 X |
| 4,491,421 | 1/1985 | Koehl et al. | 366/247 |
| 4,508,455 | 4/1985 | Lerman et al. | 366/247 |
| 4,512,666 | 4/1985 | O'Connell | 366/273 X |
| 4,548,765 | 10/1985 | Hultholm et al. | 366/327 X |
| 4,606,103 | 8/1986 | Koehl et al. | 366/247 X |

FOREIGN PATENT DOCUMENTS

| | | | |
|---|---|---|---|
| 275595 | 5/1964 | Australia | 403/379 |
| 1-199637 | 8/1989 | Japan | 366/273 |
| 176857 | 7/1935 | Switzerland | 366/326 |

*Primary Examiner*—Harvey C. Hornsby
*Assistant Examiner*—C. Cooley
*Attorney, Agent, or Firm*—Stephen R. Christian

[57] ABSTRACT

A paddle shaft assembly having adjustable-pitch paddles for use in a magnetic stirring apparatus. The paddle assembly is particularly useful for magnetic stirring apparatus used for suspending cell, or tissue, cultures in a growing medium. The paddle shaft assembly includes an upper support shaft lockable to a lower support shaft for allowing the assembly to be mounted within a magnetic stirring vessel closure. The lower shaft includes a bore for accommodating removable stirring magnets. The paddle shaft assembly further includes removable paddle members having a hollow body sized and configured to be positionable within a 360 degree arc upon end portions of stirring magnets.

3 Claims, 2 Drawing Sheets

PADDLE SHAFT ASSEMBLY WITH ADJUSTABLE-PITCH PADDLES

FIELD OF THE INVENTION

The present invention generally relates to magnetic stirring apparatuses. More particularly, the invention relates to magnetic stirring apparatuses having a stirring vessel and a closure in which a paddle assembly is mounted therein. A paddle assembly having an adjustable-pitch paddle and shaft assembly is disclosed. The invention is particularly suitable for use in magnetic stirring apparatuses used to suspend fragile tissue or cell cultures in a growing medium.

BACKGROUND OF THE INVENTION

Currently, there are a variety of magnetic stirrers used for suspending biological cells, or tissue growths, in a liquid growing medium. These stirrers typically include a vessel and a closure having a stirring member, or paddle assembly, consisting of a magnet that spins about a vertical axis upon subjecting the stirring assembly to a rotating magnetic field. Known stirring assemblies also include paddles that are designed to stir the cell culture at relative slow speeds to avoid damaging the cells as they are being mixed into the growing medium.

U.S. Pat. No. 4,512,666 discloses a prior art adjustable-height magnetic stirrer having a suspended magnetic impeller that is vertically adjustable by rotating a threaded sleeve member disposed within a threaded support member. By rotating the threaded sleeve magnetic impeller rises up, or down, depending on the direction of rotation, due to it being restrained by a bearing surface at the end of the threaded sleeve member. However, the paddle, or impeller, is of a fixed pitch and therefore the rotational speed of the impeller must be carefully monitored and controlled so as not to damage the fragile cells being stirred.

Because, the cells, or tissue, to be suspended in a growing medium are quite fragile, there is a need in the art for a paddle assembly that allows for better control of the stirring action conducted within magnetic stirring apparatuses.

OBJECTS OF THE INVENTION

An object of this invention is to provide a paddle assembly that allows for enhanced control of the stirring action as compared to existing paddle assemblies.

A further object of this invention is to provide a paddle assembly that is easy to install and that is easily removed for cleaning.

Another object of this invention is to provide an inexpensive paddle assembly that may be employed with readily available stirring magnets and existing magnetic stirring apparatuses.

A yet further object of this invention is to provide a paddle assembly that is rotationally stable when being operated.

These and other objects are achieved by the invention disclosed within the drawings and the descriptions herein.

SUMMARY OF THE INVENTION

A paddle shaft assembly having adjustable-pitch paddles for use in magnetic stirring apparatus is disclosed. The paddle shaft assembly includes an upper support shaft having a flared upper end, a first portion of a selected diameter, and a beveled transition region joining the first portion to a second portion of reduced diameter. The second portion has a hole extending perpendicularly there through at a predetermined distance from the beveled transition region for accommodating a locking pin. The paddle shaft assembly further includes a lower support shaft having two ends, one end having an axially oriented bore sized to receive the second portion of the upper support shaft. A hole extends perpendicularly through the lower support shaft for accommodating the locking pin upon being aligned with the hole in the second portion of the upper support shaft. The remaining end of the second portion of the lower support shaft has a perpendicular bore configured and dimensioned for receiving a portion of a stirring magnet removably positionable therein. A paddle member having a hollow body having an interior surface and an exterior surface. The hollow body is configured and dimensioned to be press fitted over a portion of the stirring magnet. At least one paddle is attached to and extends outwardly from the exterior surface of the hollow body.

A paddle member wherein a hollow body has two paddles positioned approximately 180 degrees from each other and wherein one of the paddles extends outwardly from the hollow body substantially less than the other paddle is also disclosed.

DETAILED DESCRIPTION OF THE DRAWINGS

Figure 3:
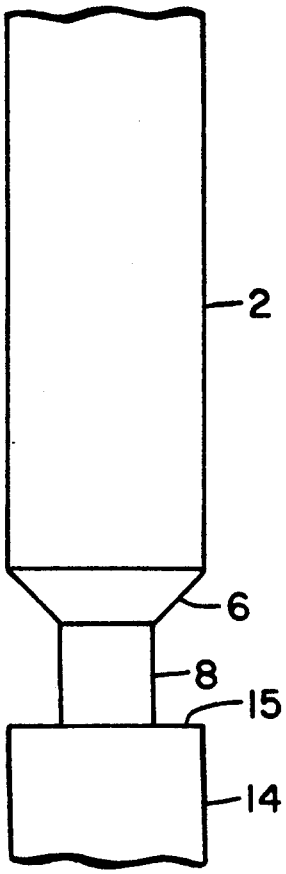
FIG. 3 is an enlarged isolated front view of beveled transition region 6 of upper support shaft 1 shown in FIGS. 1 and 2.
Figure 1:
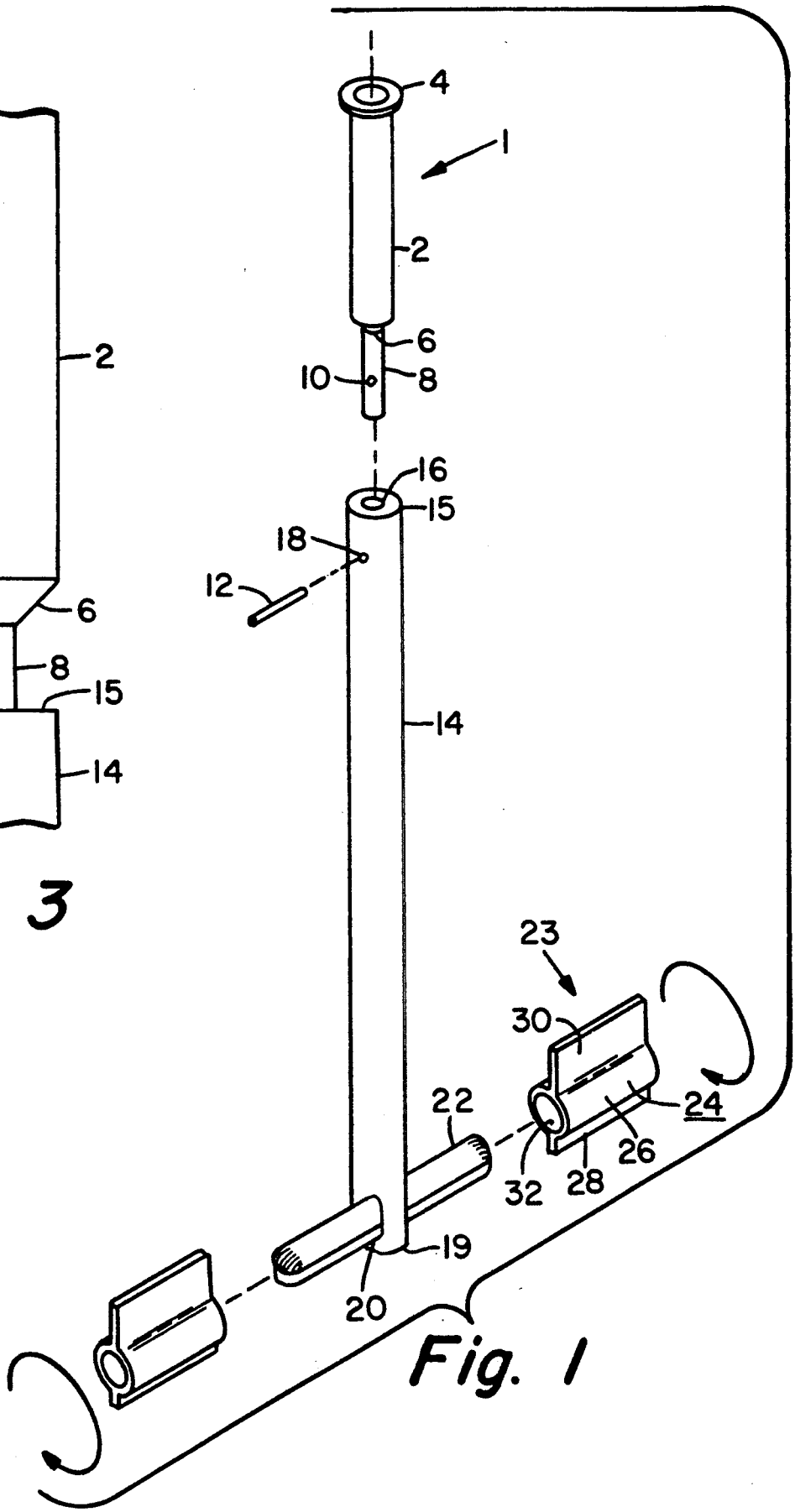
FIG. 1 is an exploded perspective view of an embodiment of the disclosed paddle shaft assembly having adjustable-pitch paddles.

Referring now to FIG. 1, the disclosed paddle shaft assembly with variable pitch paddles includes an upper support shaft 1 having an upper portion 2 having a flared end 4. Flared end 4 provides a bearing surface for limiting unwanted lateral movement of the shaft when it is installed in a magnetic stirring apparatus. The shape of flared end 4 need not be restricted to having a flat end as shown in FIG. 1, as flared end 4 may be shaped as a sphere, or other shape, because its primary purpose is to provide lateral stability to the shaft when installed in a stirring apparatus. Transition region 6 joins upper portion 2 and lower portion 8 to complete upper support shaft 1. Lower portion 8 has a smaller outside diameter than upper portion 2 and transition region 6 is preferably beveled to provide a bearing surface in which upper support shaft 1 may rotate when installed in a suitable stirring apparatus. Lower portion 8 has a perpendicularly extending hole 10 located at a preselected distance from transition region 6. The hole is sized and configured to press fittingly accept locking pin 12 therein.

Lower, support shaft 14 has an upper end 15 and a lower end 19. Lower support shaft 14 includes an axially extending bore 16 to form at least one open end in lower support shaft 14. Bore 16 may extend through out lower support shaft 14 to reduce material costs if desired. Bore 16 is sized and configured to snugly accommodate lower portion 8 of upper support shaft 1. Lower support shaft 14 includes a perpendicularly extending hole 18 for accommodating locking pin 12 therein. Hole 18 is located at a distance from upper end 15 of lower support shaft 14 so as to be alignable with hole 10, in lower portion 8 of upper support shaft 1, after upper support shaft 1 has been installed in a suitable magnetic stirring apparatus.

A perpendicularly extending hole 20 for accommodating stirring magnet 22 is located proximate to lower end 19 of lower support shaft 14. Hole 20 is sized and configured to press fittingly accept magnet 22. Magnet 22, shown in FIG. 1 as being cylinderically shaped, is representative of the shape of stirring magnets used in magnetic stirring apparatuses. However, hole 20 may be configured to accept other shaped stirring magnets.

Paddle member 23 includes a hollow body 24 having an exterior surface 26 and an interior surface 28. Hollow body 24 is sized and configured to be press fitted about stirring magnet 22. Generally, it is desirable to use a pair of paddle members, one to be fitted over each end of magnet 22. Hollow body 24 includes a paddle 30 extending outwardly from exterior surface 26. Preferably paddle 30 is rectangular in shape and extends the full length of hollow body 24. An additional paddle 32 extending outwardly from exterior surface 26 may be included on hollow body 24. Preferably paddle 32 is rectangular in shape, extends the full length of hollow body 24, and is positioned approximately 180 degrees from paddle 30. Generally, paddle 32 extends outwardly from exterior surface 26 a lesser distance than does paddle 30 in order to optimize the stirring action within the stirring vessel. However, paddles 30 and 32 may be equal in size.

The angle, or pitch, of the paddles with respect to lower support shaft 14, is adjustable by initially installing, or removing, each paddle member 23 from magnet 22 and rotating the paddle member such that the paddles on member 23 are at the desired pitch and then press fitting the paddle member onto magnet 22. Because the paddle member is press fitted onto magnet 22, the pitch of the paddles is infinitely adjustable within a 360 degree arc about the longitudinal axis of magnet 22. As a result of being able to adjust the pitch of the paddles, the rotational speed of the stirring mechanism is not as critical as it was with prior art stirring mechanisms. Therefore improved control of the stirring action within the vessel is provided by the disclosed variable-pitch paddle shaft assembly to better avoid damaging cells and tissues being suspended in growing mediums.

It is preferred to use paddle members having identical paddle profiles, paddle sizes, and pitch position in order to provide a symmetrical and consistent stirring action within the stirring vessel. However, there may be applications wherein non-identical profiles, sizes, and pitch positions may be preferred. Upper support shaft 1, lower support shaft 14, and paddle member 23 are preferably made of a non-cytotoxic material such as polypropylene (PP). Stirring magnets, such as magnet 22, are generally encapsulated by a non-cytotoxic material such as polytetrafluoroetheylene (PTFE). However, the above components may be formed, or encapsulated, with any suitable material.

Figure 2:
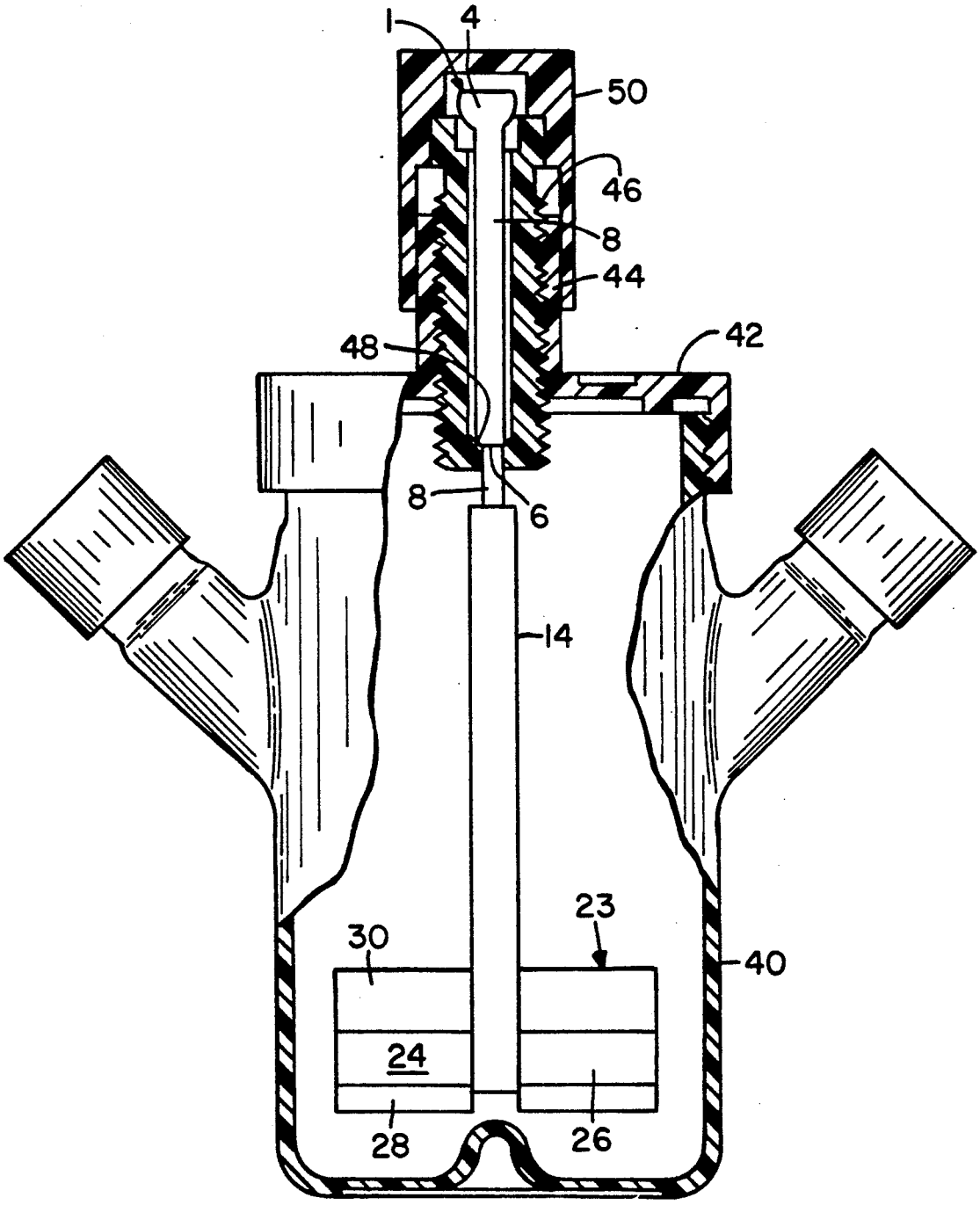
FIG. 2 a side view, partially broken away, of a magnetic stirring vessel and closure in which an embodiment of the disclosed paddle shaft assembly is installed.

Referring now to FIG. 2. FIG. 2 shows a representative magnetic stirring apparatus having the disclosed invention installed therein. The apparatus depicted is particularly well suited for stirring cells, or tissues, into a growing medium.

The apparatus shown in FIG. 2 is placed upon a magnetic stirring plate which upon activating, creates a rotating magnetic field to induce rotation of the stirring mechanism mounted within the stirrer. The stirring mechanism typically makes use of a magnet, such as magnet 22, shown in FIG. 1, which is reactive to magnetic fields.

The apparatus shown in FIG. 2 includes a vessel 40 for containing the matter to be stirred. Closure 42 seals the interior of vessel 40 and also provides a mount for securing a stirring mechanism within the apparatus. Closure 42 includes a open ended neck 44 having a hollow threaded member 46 disposed therein.

Upper support shaft 1 is first inserted through hollow threaded member 46 whereupon flared end 4 rests against the top of member 46 and transition region 6 of upper support shaft 1 rides against ledge 48 of threaded member 46. After support shaft 1 has been installed in member 46, lower support shaft 14 is pressed onto lower portion 8 of upper support shaft 4 and positioned so that holes 10 and 18 (not shown in FIG. 2) are aligned and locking pin 12 may be pressed into holes 10 and 18 thereby securing the two shafts together. Magnet 22 (not in view in FIG. 2) and paddle members 23 may now be placed into position, if not prepositioned earlier.

Matter to be stirred is introduced to vessel 40, and the closure, with the paddle shaft assembly installed, is secured about the vessel for stirring. Optional cap 50 is installed about hollow threaded member 46 for providing a convenient means for grasping and rotating threaded member 46. Grasping cap 50 and rotating the cap in a given direction causes member 46, and the disclosed paddle shaft assembly, to be raised, or to be lowered depending on the direction in which the member is rotated. Such a vertical adjustment arrangement need not be present to practice the disclosed invention, as the disclosed paddle shaft assembly may be non-adjustably mounted in the closure, provided that the assembly is free to rotate when subjected to rotating magnetic fields such as those generated by stirring plates.

Although, a detailed description of the preferred embodiment of the invention has been disclosed herein, it will be apparent to those skilled in the art that various modifications and changes can be made thereto without departing from the spirit and scope of the invention as set forth in the claims.

We claim:

1. An adjustable-paddle shaft assembly for a magnetic stirring apparatus comprising:

a) an upper support shaft having a flared upper end and a first portion of a selected diameter, a beveled transition region joining the first portion to a second portion of reduced diameter, the second portion of the upper support shaft having a hole extending perpendicularly therethrough at a predetermined distance from the beveled transition region for accommodating a locking pin;

b) a lower support shaft having two ends, one end having an axially oriented bore sized to receive the second portion of the upper support shaft, a hole extending perpendicularly through the lower support shaft for accommodating the locking pin upon the hole in the lower support shaft being aligned with the hole in the second portion of the upper support shaft, the remaining end of the lower support shaft having a perpendicular bore dimensioned and configured for receiving a portion of a removable stirring magnet; and c) at least one paddle member having a hollow body with an exterior surface, the hollow body being sized and configured to be removably press fitted over at portion of a removable magnet, the paddle member having at least one paddle attached to, and extending outwardly from, the exterior surface of the hollow body of the paddle member thereby allowing the paddle to be positioned at a preselected pitch with respect to the lower support shaft by positioning the paddle member about the magnet at the preselected pitch.

2. The paddle shaft assembly of claim 1 wherein at least one paddle member has two paddles extending outwardly from the exterior surface of the hollow body and the paddles are positioned approximately 180 degrees from each other and wherein one of the paddles extends outwardly from the exterior surface substantially less than the other paddle.

3. The paddles shaft assembly of claim 1 wherein the hollow body is cylindrically shaped.

* * * * *